United States Patent [19]

Sumitomo

[11] 3,948,062

[45] Apr. 6, 1976

[54] ELECTRONIC NEEDLE SELECTING MEANS FOR CIRCULAR KNITTING MACHINES

[75] Inventor: Norishige Sumitomo, Sakai, Japan

[73] Assignee: Precision Fukuhara Works, Inc., Kobe, Japan

[22] Filed: June 26, 1974

[21] Appl. No.: 483,287

[30] Foreign Application Priority Data

Aug. 15, 1973 Japan ..... 48-91444

[52] U.S. Cl. ..... 66/50 R; 66/154 A

[51] Int. Cl.[2] ..... D04B 9/00

[58] Field of Search ..... 66/50 R, 50 B, 154 A

[56] References Cited

UNITED STATES PATENTS

| | | | |
|---|---|---|---|
| 3,262,285 | 7/1966 | Beguin et al. | 66/50 R |
| 3,283,541 | 11/1966 | De Cerjat | 66/50 R |
| 3,365,916 | 1/1968 | Ribler et al. | 66/50 R |
| 3,512,377 | 5/1970 | Widdowson et al. | 66/50 R |
| 3,530,686 | 9/1970 | Martinetz | 66/50 R |
| 3,534,566 | 10/1970 | Farmer et al. | 66/50 R |
| 3,742,732 | 7/1973 | Plath | 66/50 B |
| 3,742,733 | 7/1973 | Paepke | 66/50 R |
| 3,747,370 | 7/1973 | De Bolt et al. | 66/50 R |
| 3,835,669 | 9/1974 | Findlay et al. | 66/50 R |
| 3,851,500 | 12/1974 | Wolfshagen | 66/50 R |
| 3,855,819 | 12/1974 | Sawazaki | 66/50 R |
| 3,861,173 | 1/1975 | Kinkelin | 66/50 R |

FOREIGN PATENTS OR APPLICATIONS

| | | | |
|---|---|---|---|
| 1,944,462 | 3/1971 | Germany | 66/50 R |

*Primary Examiner*—Mervin Stein
*Assistant Examiner*—Andrew M. Falik
*Attorney, Agent, or Firm*—Nathan Levin

[57] ABSTRACT

Electronic means for selective raising of the needles in circular knitting machines by the selective raising of jacks individually related to the needles in the cylinder needle slots, the jacks being of the rocking type having a fulcrum butt intermediate their ends. Alternate jacks are mechanically rocked to non-needle raising position while intervening jacks are mechanically rocked to needle raising position. A first electromagnet when selectively energized acts upon the intervening jacks at a point above their fulcrum butts to selectively rock selected ones of such jacks to non-needle raising position, while a second electromagnet when selectively energized acts upon the alternate jacks at a point below their fulcrum butts to selectively rock selected ones of such jacks to needle raising position. Those of such jacks which are in needle raising position are then mechanically raised thereby to raise their corresponding needles to knit level while those of such jacks which are in non-needle raising position are not raised thereby to cause their associated needles to remain at welt level.

6 Claims, 11 Drawing Figures

Figure 10:
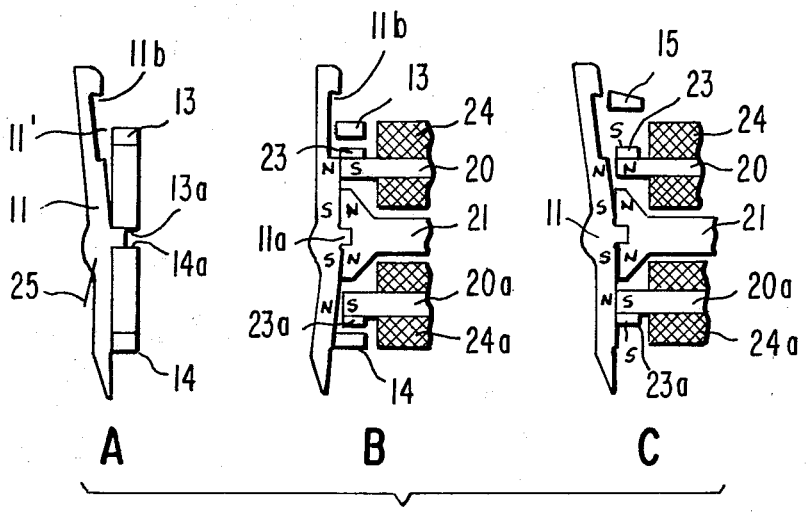

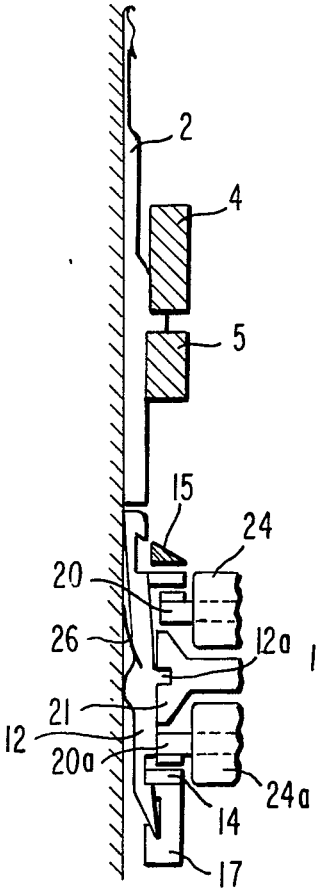
Fig. 3.
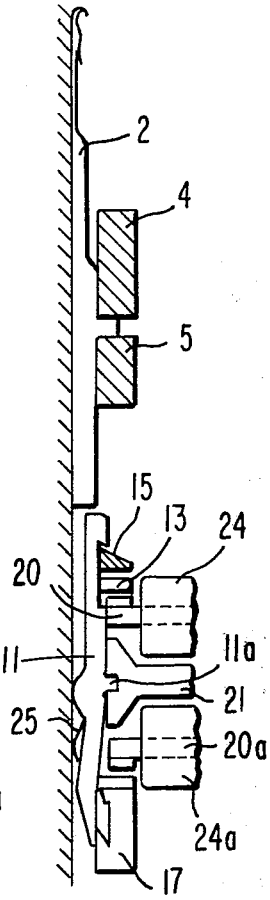
Fig. 2.
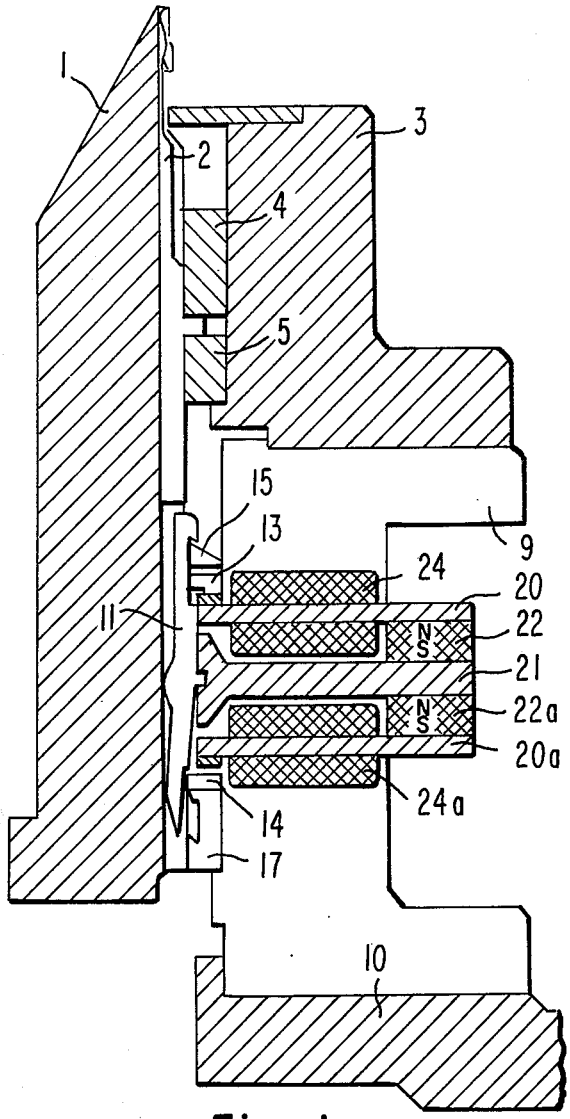
Fig. 1.
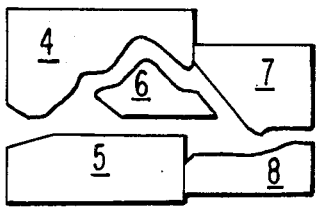
Fig. 4.
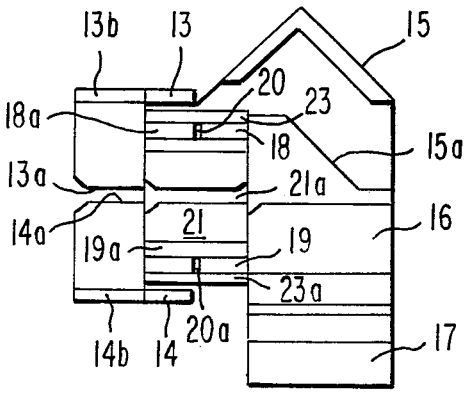
Fig. 5.
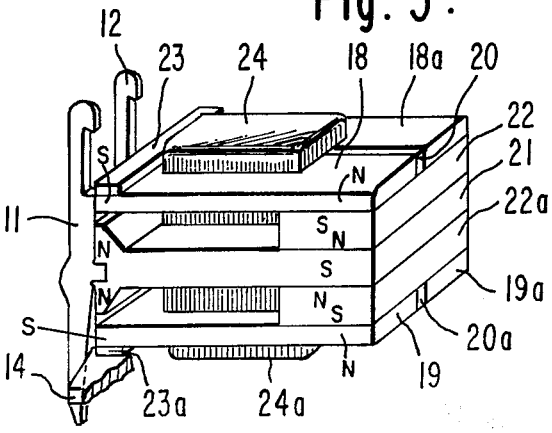

ELECTRONIC NEEDLE SELECTING MEANS FOR CIRCULAR KNITTING MACHINES

The present invention relates generally to the art of knitting and more particularly to improved electronic needle selecting means for use upon circular knitting machines for the selective raising of the needles thereof.

The electronic needle selecting means of the present invention is of the type wherein the selection is made upon needle raising jacks which transmit their selection to the needles and wherein the jacks are directly selected by the electronic means.

The jacks are of the rocking type having a fulcrum butt intermediate their ends and having a raise butt at their upper ends. Alternate jacks are mechanically rocked to welt position while intervening jacks are mechanically rocked to knit position. A first electromagnet acts upon the intervening jacks in knit position at a point above their fulcrum butts to selectively rock selected ones of such jacks to welt position, while a second electromagnet acts upon the alternate jacks in welt position at a point below their fulcrum butts to selectively rock selected ones of such jacks to knit position. Those of said jacks which are then in knit position are mechanically raised thereby to raise their associated needles to knit level while those of said jacks which are in welt position are not raised thereby to cause their associated needles to remain at welt level.

It is the principal object of the present invention to provide an electronic needle selecting means for a multi-feed circular knitting machine wherein, at each feed of the machine, a first control electromagnet acts to make a selection among the alternate needle raising jacks in welt position to move selected ones thereof to knit position, and a second control electromagnet acts to make a selection among the intermediate needle raising jacks in knit position to move selected ones thereof to welt position.

With the above and other objects in view which will become apparaent from the following detailed description of a preferred embodiment of the invention shown in the accompanying drawings, the present invention resides in the novel elements of the construction and arrangement of parts of the electronic needle selecting means illustrated and as hereinafter particularly pointed out in the appended claims.

Figure 8:
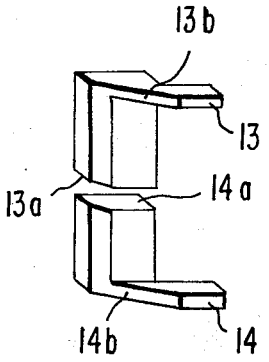
Figure 11:
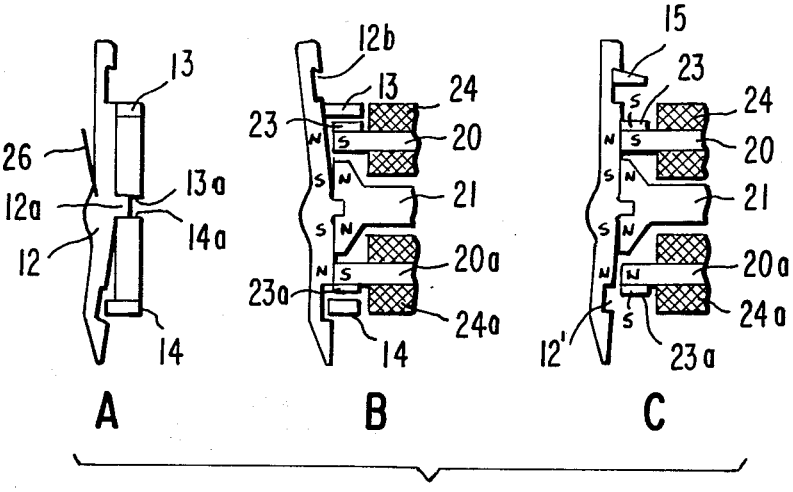
Figure 9:
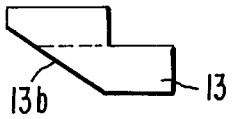
Figure 6:
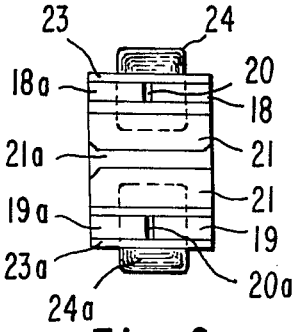
Figure 7:
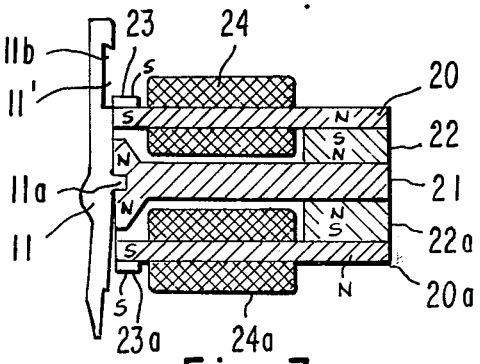

In the drawings:

FIG. 1 is a vertical sectional view of the needle cylinder and surrounding cam ring of a circular knitting machine embodying the electronic needle selecting means of the present invention and showing a needle and a rockable needle raising jack in the cylinder slot, and also showing the electronic actuator assembly for selecting the jacks, FIG. 2 is a schematic view of a portion of FIG. 1 showing one of two types of jacks in needle raising knit position, FIG. 3 is a view similar to FIG. 2 showing the other type of jack in non-needle raising welt position, FIG. 4 is a schematic face view of the needle and jack actuating cams and the electronic actuator at each feed of the knitting machine, FIG. 5 is a perspective view of the electronic actuator assembly of the present invention, FIG. 6 is a face view of the jack operating end of the actuator of FIG. 5, FIG. 7 is a vertical sectional view of the actuator of FIG. 6 shown in relation to one of the jacks selected thereby, FIG. 8 is a perspective view of the cams used to initially rock the jacks, FIG. 9 is a plan view of FIG. 8, FIG. 10 is a schematic view of one of the two types of jacks in three of its positions during the selection thereof, and FIG. 11 is a view similar to FIG. 10 of the other type of the jacks.

The needle cylinder of the circular knitting machine embodying the present invention is shown at 1 in FIG. 1 with vertically movable needls 2 in the slots of the cylinder. The surrounding cam ring 3 is provided with cams 4, 5, 6, 7 and 8, FIG. 4, at each feed of the machine, to act upon the needle butts in customary manner. Cam ring 3 is spaced from base ring 10 of the machine by supports 9 upon which an electronic actuator assembly and other cams are supported at each feed of the machine. In the needle slots and below the alternate needles are jacks 11 of a first type while below the intervening needles are jacks 12 of a second type. The jacks 11, 12 are rockable about radially extending butts 11*a*, 12*a*, respectively, and are also movable vertically when in knit position to raise their corresponding needles. A jack in knit position is one which is in position to be raised by a jack raise cam thereby to raise its associated needle to yarn taking knit or latch clearing level or position, while a jack in welt position is one which is not in position to be raised by the jack raise cam thereby to leave its associated needle in non-yarn taking welt or non-raised level or position.

Vertically spaced cams 13, 14, having sloping cam faces 13*b*, 14*b* and a pathway between the adjacent sides 13*a*, 14*a* thereof, are provided to guide the jacks 11, 12 and to rock the same. As the jacks move from left to right, FIG. 4, their butts travel along the aforesaid pathway between the cams 13, 14 while cam face 13*b* engages jacks 12 to rock the same in counter clockwise direction, FIG. 3, and cam face 14*b* engages jacks 11 to rock the same in clockwise direction, FIG. 2. Jacks 12 are suitably cut out at 12', FIG. 11, to avoid contact with cam 14 while jacks 11 are similarly cut out at 11', FIG. 10, to avoid contact with cam 13.

As the jacks leave the influence of cams 13, 14, they come under the influence of the electronic actuator assembly shown in FIG. 5. This assembly comprises a radially extending pole plate 21 of generally rectangular shape having a horizontal extending pathway 21*a* formed in the face of its inner end and along which the butts 11*a*, 12*a* of the jacks are adapted to pass as they continue their travel. Rectangularly shaped permanent magnets 22, 22*a* are placed crosswise above and below the outer end of plate 21, respectively. A pair of horizontally spaced pole plates 18, 18*a*, having the same general overall outline as plate 21, are placed above magnet 22 while a similar pair of pole plates 19, 19*a* are placed below magnet 22*a*. Clamped between and extending lengthwise of plates 18, 18*a* and 19, 19*a* are radially extending relatively thin pole plates 20, 20*a*, respectively, the latter plates being approximately 1 to 2 mm in thickness. The plates 18, 18*a* and 19, 19*a* are cut out to provide space therein for magnetic coils 24, 24*a*, respectively, and which encircle the plates 20, 20*a*. Extending across the top sides of the inner ends of plates 18, 18*a*, at the jack side of coil 24, is pole plate 23, while extending across the bottom sides of the inner ends of plates 19, 19*a*, at the jack side of coil 24*a*, is pole plate 23*a*. The cut out 11′ in jack 11 is sufficiently long so that contact between plate 23 and jack 11 is avoided. Similarly, the cut out 12′ in jack 12 is sufficiently long so that contact between plate 23*a* and jack 12 is avoided. While the plates 23, 23*a*, 18, 18*a*, 19, 19*a* and 21, maintain the same polarity, FIGS. 5, 7, at all times, the polarity of the plates 20, 20*a* is selectively reversed when coils 24, 24*a* are selectively energized or pulsed with current. It will be noted that jacks 11 each have a light spring in a notch thereof so as to extend downwardly and rearwardly from a point below butt 11*a*, the springs bearing against the bottom of the needle slots to urge jacks 11 in counter clockwise direction about butt 11*a*, FIG. 2. Similarly, each of the jacks 12 have a similar spring 26 extending upwardly and rearwardly thereof from a point above butt 12*a*, the spring bearing against the bottom of the needle slots to urge jacks 12 in clockwise direction about butt 12*a*, FIG. 3.

As shown in FIGS. 4, 10, each jack 11, before it reaches cam face 14*b*, is welt position A, and after it moves along and has been rocked by cam 14 it is in knit position B as it leaves the influence of cam 14 and reaches the selecting area opposite plate 20. Thereafter, if coil 24 is not pulsed, jack 11 is retained in position B by the opposite polarity between jack 11 and pole plate 20 as well as by the force of the opposite polarity between jack 11 and the portion of pole plate 21 above butt 11*a*. Jack 11 continues along in knit position until it engages and is raised by a raise cam 15, the action of which will be described. However, if coil 24 is pulsed when jack 11 is substantially opposite pole plate 20, the polarity of the latter is changed to N, the same polarity as the jack, and the jack is repelled thereby to rock about its butt 11*a* to the welt position C, the jack being retained in welt position as it continues along pathway 21*a* by the opposite polarity between the jack and plates 20*a*, 23*a* and 21. Jack 11 continues along in welt position and passes raise cam 15 without being raised thereby.

As shown in FIGS. 4 and 11, each jack 12, before it reaches cam face 13*b* is in knit position A, and after it moves along and has been rocked by cam 13 it is in welt position B as it leaves the influence of cam 13 and reaches the selecting area opposite pole plate 20*a*. Thereafter, if coil 24*a* is not pulsed jack 12 is retained in position B by the opposite polarity between jack 12 and pole plate 20*a* as well as by the opposite polarity between jack 12 and the portion of pole plate 21 below butt 12*a*. Jack 12 continues along in welt position and passes cam 15 without being raised thereby. However, if coil 24*a* is pulsed when jack 12 is substantially opposite pole plate 20*a*, the polarity of the latter is changed to N, the same polarity as the jack, and the jack is repelled thereby to rock about its butt 12*a* to the knit position C, the jack being retained in knit position as it continues along pathway 21*a* by the opposite polarity between the jack and plates 20, 23 and 21. Jack 12 continues along in knit position until it reaches the influence of cam 15 and is then raised thereby. Springs 25, 26, which serve to urge the jacks to their A positions in FIGS. 10 and 11, are held compressed when the jacks are rocked by cams 13, 14 to their B positions. Then, as to selected jacks, the springs aid in moving the same to their C positions.

Jacks 11, 12 are provided at their upper ends with notches 11*b*, 12*b*, respectively. (notch 11*b* being in continuation of cut out 11′ ) so that those jacks which reach cam 15 in knit position, FIG. 10 B and FIG. 11 C, are so placed that cam 15 enters into the notches to engage and to raise the corresponding jacks and their associated needles. Those jacks which reach cam 15 in welt position, FIG. 10 C and FIG. 11 B, are so placed that cam 15 cannot enter their notches and such jacks and their needles are not raised. The butts of all the needles first pass between cams 4,5, then the butts of those needles which have been raised (by the action of cam 15 on corresponding jacks 11, 12 in knit position) pass upwardly between cams 4 and 6 and are raised by the latter to knit or latch clearing position afterwhich such raised needles are lowered by the action of cam 7 on their butts. The butts of those needles which have not been raised (their corresponding jacks having been in welt position and not raised by cam 15) pass below cam 6 and between cams 7 and 8, the latter being a cushion cam. All the needles then continue to the next feed of the machine. The face 15*a* of cam 15 acts upon the butts 11*a*, 12*a* of raised jacks to lower the same, these jacks butts then continuing on in the pathway between 15*a*, and cam 16. As to those jacks which have passed the electronic actuator assembly in welt position, the lower ends thereof enter and are retained in a pathway formed in cam 17, FIG. 3, as they travel with the needle cylinder. The lower ends of those jacks which have passed the electronic actuator in knit position do not enter into the pathway in cam 17, FIG. 2.

Coils 24 and 24*a* are caused to be selectively energized to reverse the polarity of their plates 20, 20a, respectively, by means of a suitable electronic control mechanism, in accordance with a desired pattern in such manner as to be pulsed alternately, that is, coil 24 is pulsed, as needed, only when jacks 11 are opposite plate 20 and coil 24*a* is pulsed as needed, only when jacks 12 are opposite plate 20*a*. In this manner the time within which each of the coils 24, 24a need be pulsed is increased to substantially twice the usual amount of time thereby making the present invention applicable to finer cuts of machines while maintaining accuracy of needle selection. While the jacks are selected by magnetic repelling force, it is within the scope of the present invention to have the jacks selected by magnetic attracting force.

I claim:

1. An electronic needle selecting device for a circular knitting machine having a circle of needles and a circle of jacks individually associated with the circle of needles, said jacks being movable between active and inactive positions and being adapted to be raised to raise said needles when in their active position, alternate ones of said jacks comprising a first series thereof while intervening ones of said jacks comprise a second series thereof, first jack moving means to move said jacks of said first series thereof to their active position, first electromagnetic means in addition to said first jack moving means and being operatively related to said first series of jacks to thereafter move selected ones thereof from their active to their inactive position when said first electromagnetic means is selectively pulsed according to a predetermined pattern, second jack moving means to move jacks of said second series thereof to their inactive position, second electromagnetic means in addition to said second jack moving means and being operatively related to said second series of jacks to thereafter move selected ones thereof from their inactive to their active position when said second electromagnetic means is selectively pulsed according to a predetermined pattern, and additional jack moving means following said first and said second electromagnetic means to thereafter raise those of said jacks of both of said series thereof which are in their active position thereby to raise such needles as are associated with such raised jacks, those of said jacks of both of said series thereof which are in their inactive position not being raised by said additional jack moving means whereby such needles as are associated with such non-raised jacks are not raised.

2. Device as in claim 1 wherein each of said jacks is a lever of the type which is rockable about a fulcrum intermediate its ends, and wherein said jacks are rockable about their said fulcrums in their movements between their said active and inactive positions.

3. Device as in claim 2 wherein said first jack moving means is a first jack cam, wherein said first jack cam acts upon said first series of jacks at one side of their fulcrums thereby to rock such jacks to their said active position, wherein said second jack moving means is a second jack cam, and wherein said second jack cam acts upon said second series of jacks at the other side of their said fulcrums thereby to rock such jacks to their said inactive position.

4. Device as in claim 3 wherein said first electromagnetic means acts upon said first series of jacks at said other side of their said fulcrums to rock selected ones of such jacks from their said active to their said inactive position, and wherein said second electromagnetic means acts upon said second series of jacks at said one side of their said fulcrums to rock selected ones of such jacks from their said inactive to their said active position.

5. Device as in claim 4 wherein first magnetic means is provided to magnetically retain said jacks of said first series thereof in their said active position when the latter are moved thereto by said first jack cam, wherein second magnetic means is provided to magnetically retain said jacks of said second series thereof in their said inactive position when the latter are moved thereto by said second jack cam, wherein said first magnetic means also magnetically retains said selected ones of said second series of jacks in their said active position when the latter are moved thereto by said second electromagnetic means, and wherein said second magnetic means also magnetically retains said selected ones of said first series of jacks in their said inactive position when the latter are moved thereto by said first electromagnetic means.

6. Device as in claim 5 wherein said first electromagnetic means acts to move said selected ones of said first series of jacks to their said inactive position by magnetically repelling the same when said first electromagnetic means is pulsed, and wherein said second electromagnetic means acts to move said selected ones of said second series of jacks to their said active position by magnetically repelling the same when said second electromagnetic means is pulsed.

* * * * *